US008633883B2

(12) United States Patent
Song et al.

(10) Patent No.: US 8,633,883 B2
(45) Date of Patent: Jan. 21, 2014

(54) LIQUID CRYSTAL DISPLAY

(75) Inventors: Hong Sung Song, Gumi-si (KR); Chaeyoul Cho, Ansan-si (KR); Woongki Min, Daegu (KR); Yonggi Son, Milyang-si (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 879 days.

(21) Appl. No.: 12/314,447

(22) Filed: Dec. 10, 2008

(65) Prior Publication Data

US 2009/0146935 A1 Jun. 11, 2009

(30) Foreign Application Priority Data

Dec. 11, 2007 (KR) ..... 10-2007-0128483
Jun. 3, 2008 (KR) ..... 10-2008-0052261

(51) Int. Cl.
*G09G 5/00* (2006.01)
*G09G 3/14* (2006.01)
*G09G 3/04* (2006.01)

(52) U.S. Cl.
USPC ..... 345/95; 345/39; 345/33; 345/3.1

(58) Field of Classification Search
USPC ..... 345/39
See application file for complete search history.

(56) References Cited

U.S. PATENT DOCUMENTS 4,021,842 A * 5/1977 Campioni ..... 348/640
6,067,645 A * 5/2000 Yamamoto et al. ..... 714/57
6,151,334 A * 11/2000 Kim et al. ..... 370/468
7,518,600 B2 * 4/2009 Lee ..... 345/204
2002/0047557 A1 * 4/2002 Kim ..... 315/169.3
2003/0107987 A1 * 6/2003 Kinstler ..... 370/228
2003/0112380 A1 * 6/2003 Lee et al. ..... 348/836
2005/0020228 A1 * 1/2005 Yearim ..... 455/260
2007/0200859 A1 * 8/2007 Banks et al. ..... 345/520
2007/0200860 A1 * 8/2007 Kobayashi ..... 345/520

FOREIGN PATENT DOCUMENTS

JP 2007-36054 A 2/2007
JP 2007-67531 A 3/2007

* cited by examiner

*Primary Examiner* — Alexander S Beck
*Assistant Examiner* — Mihir Rayan
(74) *Attorney, Agent, or Firm* — McKenna Long & Aldridge LLP

(57) ABSTRACT

The exemplary embodiment relates to a liquid crystal display device. The liquid crystal display panel according to the exemplary embodiment includes: a liquid crystal display panel on which a plurality of data lines cross a plurality of gate lines; a source drive IC that supplies data voltages to the data lines; a gate drive IC that supplies gate pulses to the gate lines; a system board equipped with a scaler that transmits data from the scaler with a first interface specification; an interface board that receives the data according to the first interface specification, and transmitting the data with a second interface specification; and a control board equipped with a timing controller receiving the data in the second interface specification and supplying the data to the source drive IC, and controlling the operating timing of the source drive IC and the gate drive IC; wherein a number of the data transmitting lines required in the second interface specification is less than a number of data transmitting line required in the first interface specification.

1 Claim, 6 Drawing Sheets

LIQUID CRYSTAL DISPLAY

This application claims the benefit of Korea Patent Applications No. 10-2007-00128483 filed on Dec. 11, 2007 and No. 10-2008-0052261 filed on Jun. 3, 2008, which are hereby incorporated by reference for all purposes as if fully set forth herein.

BACKGROUND OF THE INVENTION

1. Field of the Invention

The present invention relates to a liquid crystal display device.

2. Discussion of the Related Art

Liquid crystal displays may have the characteristics of being light weight, slim, and low power. Liquid crystal displays are applied to portable computers such as note book personal computers, official automation devices, audio/video devices, and external/internal advertising display devices. The transparent type of liquid crystal display device which is the type most often used, displays the picture data by modulating the luminescence of the light incident from the backlight unit by controlling the electric field applied to a liquid crystal layer.

The liquid crystal display device includes a liquid crystal display module and a driving circuit for the liquid crystal display module. The driving circuit of the liquid crystal display module includes the following: a data driving circuit for supplying data voltages to the data lines of the liquid crystal display panel, a gate driving circuit for supplying a scan pulse to the scan lines of the liquid crystal display panel, and a timing controller for controlling the operating timing of the driving circuits. The timing controller is equipped with a control board and the ICs of the data driving circuit are mounted on a source PCB (Printed Circuit Board). A FPC (Flexible Printed Circuit) is located between the control board and the source PCB. Digital video data and the timing control signals are transmitted through the FPC. The control board is connected to the system board through an interface cable. A scaler converts the resolution of the video data according to the resolution of the liquid crystal display panel and sends the data to the control board.

The number of lines of the interface cable connecting between the system board and the control board is determined by the amount of the data and the clock signals to be sent. Typically, when the liquid crystal display device is in the Full-HD 120 Hz mode, the interface cable between the system board and the control board can have 48 lines if the type of interface that is applied is LVDS (Low-Voltage Differential Signaling). As mentioned above, even though the LVDS interface type is used, the interface cable still may have a lot of lines. Therefore, the number of connector pins used for connecting the interface cable to the system board and the control board may be a lot as well. Costs increase due to the number of interface cables and connectors used. Furthermore, due to the high frequencies being transmitted through the interface cable by the clock signal there is a high EMI (Electromagnetic interference) problem.

Recently, new interface types having lower EMI and fewer transmitting lines than those of LVDS interface types are being developed. However, until the conventional LVDS interface may be fully replaced with the new type interface, the newly developed interfaces and the conventional LVDS interfaces should be used contemporaneously. Therefore, there is a need to connect the newly developed interfaces with the conventional LVDS interfaces making them compatible with one another.

SUMMARY OF THE INVENTION

Accordingly, the present invention is directed to a liquid crystal display (LCD) that substantially obviates one or more of the problems due to limitations and disadvantages of the related art.

An advantage of the present invention is to provide a liquid crystal display device that is compatible with the connections of at least two different interfaces.

Another advantage of the present invention is to provide a fewer number of data transmitting lines required for the second interface type than the number of data transmitting lines required for the first interface type.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a liquid crystal display device including: a liquid crystal display panel on which a plurality of data lines cross a plurality of gate lines; a source drive IC that supplies data voltages to the data lines; a gate drive IC that supplies gate pulses to the gate lines; a system board equipped with a scaler that transmits data from the scaler with a first interface specification; an interface board that receives the data according to the first interface specification, and transmitting the data with a second interface specification; and a control board equipped with a timing controller receiving the data in the second interface specification and supplying the data to the source drive IC, and controlling the operating timing of the source drive IC and the gate drive IC; wherein a number of the data transmitting lines required in the second interface specification is less than a number of data transmitting line required in the first interface specification.

In another aspect of the present invention the liquid crystal display device includes: a liquid crystal display panel on which a plurality of data lines cross a plurality of gate lines; a source drive IC supplying data voltages to the data lines; a gate drive IC supplying gate pulses to the gate lines; a system board equipped with a scaler that transmits data from the scaler through an interface that includes 4-pair of data transmitting lines; and a control board equipped with a timing controller that receives the data through the interface and supplies the data to the source drive IC and controls the operating timing of the source drive IC and the gate drive IC.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, examples of which are illustrated in the accompanying drawings.

Figure 1:
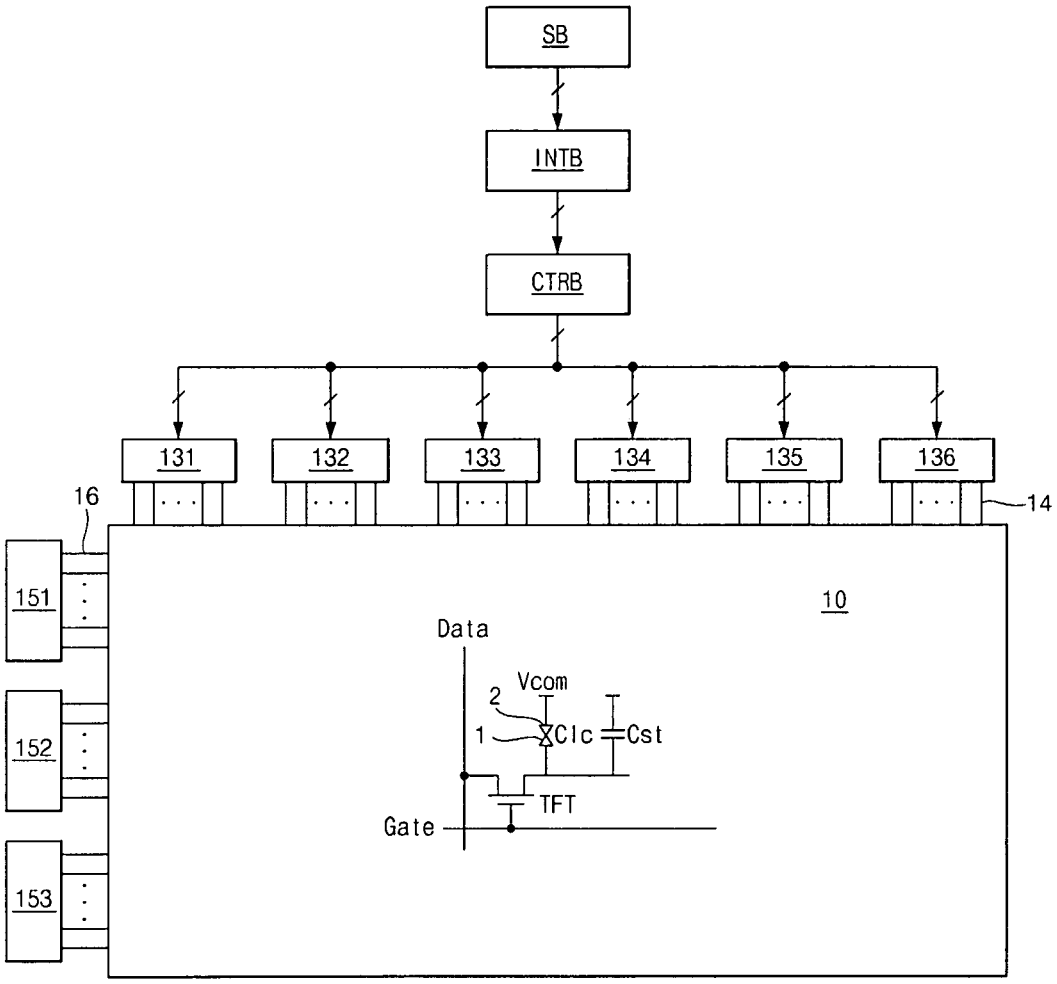
FIG. 1 is a block diagram illustrating a liquid crystal display device according to one exemplary embodiment of the present application.

Referring to FIG. 1, the liquid crystal display device according to the first exemplary embodiment includes a liquid crystal display panel 10, a plurality of gate drive IC's (Integrated Circuit) 151 to 153, a plurality of source drive IC's 131 to 136, a system board (SB), an interface board (INTB), and a control board (CTRB).

The liquid crystal display panel 10 comprises two glass substrates and a liquid crystal layer substantially located in between the glass substrates. Liquid crystal cells of the liquid crystal display panel 10 are disposed in substantially a matrix pattern formed by the data lines 14 crossing gate lines 16.

On the lower glass substrate of the liquid crystal display panel 10, data lines 14, gate lines 16, TFTs (Thin Film Transistor(s)), and liquid crystal cells (Clc) may be connected to the TFTs and driven by the electric field between the pixel electrodes 1 and the common electrode 2, and storage capacitors (Cst).

On the upper glass substrate of the liquid crystal display panel 10, a black matrix, a color filter, and a common electrode 2 may be formed.

The common electrode 2 may be substantially formed on the upper glass substrate for the vertical electric field driving type such as TN mode (Twisted Nematic mode) and VA mode (Vertical Alignment mode). However, for the horizontal electric field driving type such as an IPS mode (In-Plane Switching mode) and a FFS mode (Fringe Field Switching mode), the common electrode 2 may be substantially formed on the lower glass substrate with the pixel electrode 1. On the outer surfaces of the upper and lower glass substrates of the liquid crystal display panel 10, polarization plates may be attached. On the inner surface of the upper and lower glass substrate of the liquid crystal display panel 10, alignment layers to provide a pre-tilt angle of the liquid crystal material may be formed.

The source drive ICs 131 to 136 receive the digital video data transmitted by the mini LVDS (Low-voltage differential signaling) method, from the control board (CTRB), converts the data into analog data voltages according to the data timing control signal from the control board (CTRB), and supplies the data to the data lines 14 of the liquid crystal display panel 10. Each source drive IC is equipped with a mini LVDS receiving circuit for receiving and demodulating the mini LVDS data.

Each gate drive IC, 151 to 153, generates a gate pulse according to the gate timing control signals from the control board (CTRB) and sequentially supply the gate pulse to the gate lines 16.

The system board (SB) can substantially convert the resolution of the digital video data to the proper resolution of the liquid crystal display panel 10. Then, by using the LVDS interfacing method, the system board (SB) may send digital video data and timing signals from the LVDS clock to the interface board (INTB). The timing signals include a V synch signal, a Hsynch signal, the data enable signal, and a Dot clock signal.

The interface board (INTB) may receive the digital video data and LVDS clock signals from the system board through the LVDS interface receiving circuit, and may convert these signals to a Vbyone interface type signal. After sending the auxiliary signal to the Vbyone receiving circuit with the Vbyone interface method and then receiving the response signal from the Vbyone receiving circuit, the interface board (INTB) may transmit the digital video data and the timing signal to the control board (CTRB). Electromagnetic interface may be decreased when the auxiliary signals are sent at a low frequency prior to the digital video data and the timing signals being sent.

The control board (CTRB) may receive Vbyone data and may substantially convert this data to mini LVDS data. Along with the mini LVDS data, the control board (CTRB) may also transmit the mini LVDS clock data to the source drive ICs 131 to 136. Also, the control board (CTRB) may generate the data timing control signal for controlling the operating timing of the source drive ICs 131 to 136 and the gate timing control signal for controlling the operating timing of the gate drive ICs 151 to 153. Next explained will be the signal wiring connection and operation of the system board (SB), interface board (INTB) and control board (CTRB) of the liquid crystal display panel 10 with respect to the Full-HD 120 Hz mode.

Figure 2:
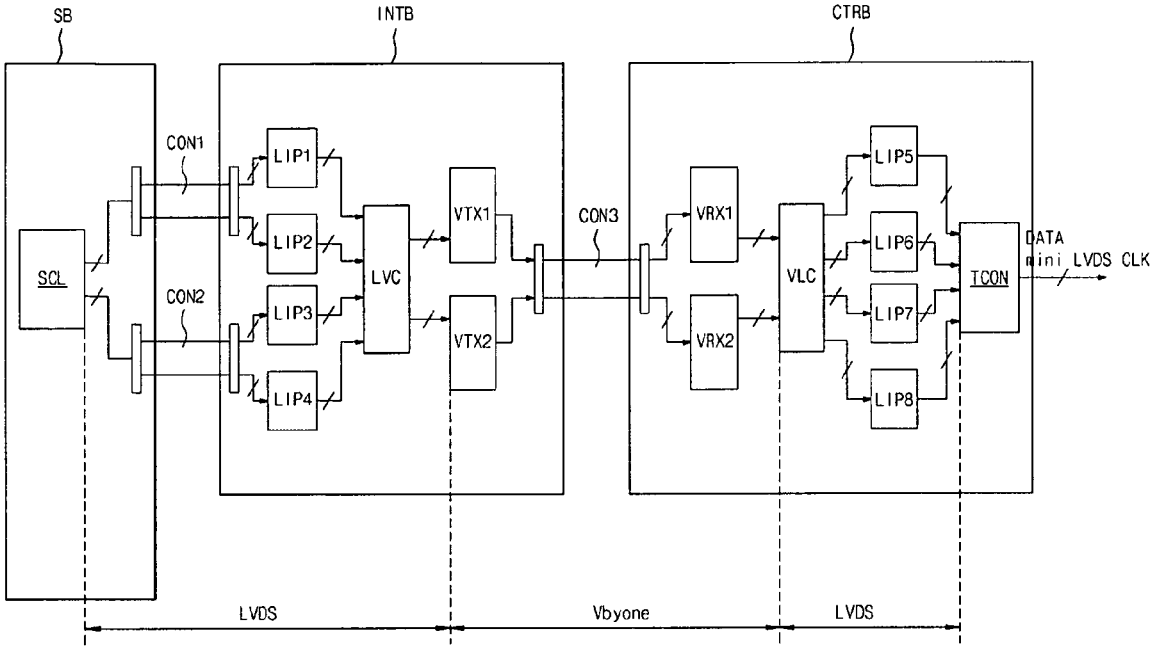
FIG. 2 is a block diagram illustrating a system board, an interface board and a control board shown in the FIG. 1 in detail.

FIG. 2 illustrates the system board (SB), the interface board (INTB), and the control board (CTRB) in detail.

Referring to FIG. 2, the system board (SB) may be equipped with a scaler (SCL). The scaler (SCL) may be equipped with the LVDS transmitting circuit. The scaler (SCL) may substantially convert the resolution of the digital video data, and transmit the digital video data along with the timing signal and the LVDS clock data to the interface board (INTB) through the LVDS transmitting circuit.

The system board (SB) and the interface board (INTB) may be connected through connectors to the first and the second cables (CON1 and CON2). The first and the second cables (CON1 and CON2) each may have 24-pair of transmitting lines. The 24-pairs of transmitting lines include both a 20-pair data transmitting lines for sending the digital video data and 4-pairs of LVDS clock transmitting lines for sending the timing signals. The first cable (CON 1) may include a 10-pair data transmitting line and a 2-pair LVDS clock transmitting line. The second cable (CON2) may include a 10-pair data transmitting line and 2-pair of LVDS clock transmitting line.

The interface board (INTB) may include: a first, second, third, and fourth LVDS receiving circuits (LIP1 to LIP4), a LVDS-Vbyone relay circuit (LVC), and a first and a second Vbyone transmitting circuit (VTX1 and VTX2).

By configuring the first cable (CON1) with 10-pairs of data transmitting lines and 2-pairs of LVDS clock transmitting lines the first LVDS receiving circuit (LIP1) may receive the digital video data and the timing signals associated with the LVDS clock from the system board (SB). From an LVDS clock perspective, the first LVDS receiving circuit (LIP1) may demodulate the digital video data and transmit the data to the LVDS-Vbyone relay circuit (LVC). By configuring the first cable (CON1) with 10-pairs of data transmitting lines and 2-pair of LVDS clock transmitting lines, the second LVDS receiving circuit (LIP2) may receive the digital video data and the timing signals associated with the LVDS clock from the system board (SB). From a LVDS clock perspective, the second LVDS receiving circuit (LIP2) may demodulate the digital video data and transmit the data to the LVDS-Vbyone relay circuit (LVC). By configuring the second cable (CON2) to include 10-pair of data transmitting lines and 2-pair of LVDS clock transmitting lines, the third LVDS receiving circuit (LIP3) may receive the digital video data and the timing signals associated with the LVDS clock, from the system board (SB). From an LVDS clock perspective, the third LVDS receiving circuit (LIP3) may demodulate the digital video data and transmit the data to the LVDS-Vbyone relay circuit (LVC). By configuring the second cable (CON2) to include 10-pair of data transmitting lines and 2-pairs of LVDS clock transmitting lines, the fourth LVDS receiving circuit (LIP4) may receive the digital video data and the timing signals associated with the LVDS clock, from the system board (SB). From an LVDS clock perspective, the fourth LVDS receiving circuit (LIP4) may demodulate the digital video data and transmits the data to the LVDS-Vbyone relay circuit (LVC).

The LVDS-Vbyone relay circuit (LVC) may include a LVDS receiving circuit. By disposing the LVDS-Vbyone relay circuit (LVC) between the LVDS receiving circuits (LIP1 to LIP4) and the Vbyone receiving circuits (VTX1 and VTX2), the digital video data may be demodulated from the LVDS receiving circuits (LIP1 to LIP4) with the LVDS clock. The LVDS-Vbyone relay circuit (LVC) may substantially distribute the demodulated digital video data and the timing signals to the Vbyone transmitting circuit (VTX1 and VTX2).

The first Vbyone transmitting circuit (VTX1) may be connected to the LVDS-Vbyone relay circuit (LVC) for substantially compressing the digital video data and for outputting the compressed digital video data with the timing signals. The second Vbyone transmitting circuit (VTX2) may be connected to the LVDS-Vbyone relay circuit (LVC) for substantially compressing the digital video data and for outputting the compressed digital video data with the timing signals. Each of the Vbyone transmitting circuits (VTX1 or VTX2) may not generate the clock signal nor generate an auxiliary signal for switching the operation of the Vbyone receiving circuit of the control board (CTEB) to the receiving mode.

The interface board (INTB) may be connected to the control board (CTRB) via the third cable (CON3) through the connector. The third cable (CON3) may include 4-pair of data transmitting lines and 2-pair of auxiliary signal transmitting lines. The digital video data and the timing signals output from the first Vbyone transmitting circuit (VTX1) may be sent to the control board (CTRB) through 2-pair of data transmitting lines located at the third cable (CON3). The auxiliary signal outputted from the first Vbyone transmitting circuit (VTX1) may be sent to the control board (CTRB) through 1-pair of auxiliary signal transmitting lines located at the third cable (CON3). The digital video data and the timing signal outputted from the second Vbyone transmitting circuit (VTX2) may be sent to the control board (CTRB) through the other 2-pair of data transmitting lines located at the third cable (CON3). The auxiliary signals output from the second Vbyone transmitting circuit (VTX2) may be sent to the control board (CTRB) through another pair of auxiliary signal transmitting lines located at the third cable (CON3).

The control board (CTRB) may include first and second Vbyone receiving circuits (VRX1 and VRX2), a Vbyone-LVDS relay circuit (VLC), fifth, sixth, seventh, and eighth LVDS receiving circuits (LIP5 to LIP8), and a timing controller (TCON).

After sending a response signal with the first Vboyne transmitting circuit (VTX1) in response to receiving an auxiliary signal, the first Vbyone receiving circuit (VRX1) may receive and demodulate the digital video data received from the first Vbyone transmitting circuit (VTX1) through the third cable (CON3), and then the Vboyne receiving circuit (VRX1) may then send the data to the Vbyone-LVDS relay circuit (VLC). After sending a response signal with the second Vbyone transmitting circuit (VTX2) in response to receiving an auxiliary signal, the second Vbyone receiving circuit (VRX2) may receive and demodulate the digital video data received from the second Vbyone transmitting circuit (VTX2) through the third cable (CON3), and then the Vbyone receiving circuit (VRX2) may then send the data to the Vbyone-LVDS relay circuit (VLC).

The Vbyone-LVDS relay circuit (VLC) may include a LVDS transmitting circuit for substantially converting the digital video data of the Vbyone-LVDS and for substantially generating the LVDS clock signal in substantial accordance with the LVDS interface specification. The Vbyone-LVDS relay circuit (VLC) may convert the digital video data from the first and the second Vbyone receiving circuits (VRX1 and VRX2) in substantial accordance with the LVDS interface specification, and may substantially distribute the digital video data and the LVDS clock signal with the timing signals to the fifth, sixth, seventh, and eighth LVDS receiving circuits (LIP5 to LIP8).

Each of the LVDS receiving circuits (LIP5 to LIP8) may receive the LVDS clock signal along with the digital video data and the timing signals through the 10-pairs of data transmitting lines and the pair of LVDS clock transmitting lines located at the control board (CTRB). After substantially demodulating the digital video data in accordance with the LVDS clock, each of the LVDS receiving circuits (LIP5 to LIP8) may transmit the demodulated video data to the timing controller (TCON). Therefore, located between the Vbyone-LVDS relay circuit (VLC) and the LVDS receiving circuits (LIP5 to LIP8), there can be 40-pair of data transmitting lines and 4-pair of LVDS clock transmitting lines.

The timing controller (TCON) may include a timing control signal generating circuit in the driving circuit, a data sampling circuit, and a mini LVDS transmitting circuit. By using the received timing signals such as Vsync, Hsync, data enable signal, and the dot clock signal, the timing controller (TCON) may generate the data timing control signal for controlling the operation timing of the source drive ICs 131 to 136 and for controlling the polarity of the data voltage supplied to the liquid crystal display panel 10. The timing controller (TCON) may also generate the gate timing control signal for controlling the operating timing of the gate drive ICs 151 to 153. In addition, the timing controller (TCON)

may transmit the mini LVDS clock signal along with the digital video data to the source drive ICs 131 to 136 in substantial accordance with the mini LVDS interface specification.

Therefore, the liquid crystal display device according to the first exemplary embodiment may transmit the data from the system board (SB) to the interface board (INTB) using the LVDS interface transmitting method. The liquid crystal display device may also transmit the data from the interface board (INTB) to the control board (CTRB) using the Vbyone interface transmitting method. As a result, it may be possible to remove the clock transmitting lines between the interface board (INTB) and the control board (CTRB) so that the EMI may be minimized between the boards.

Figure 3:
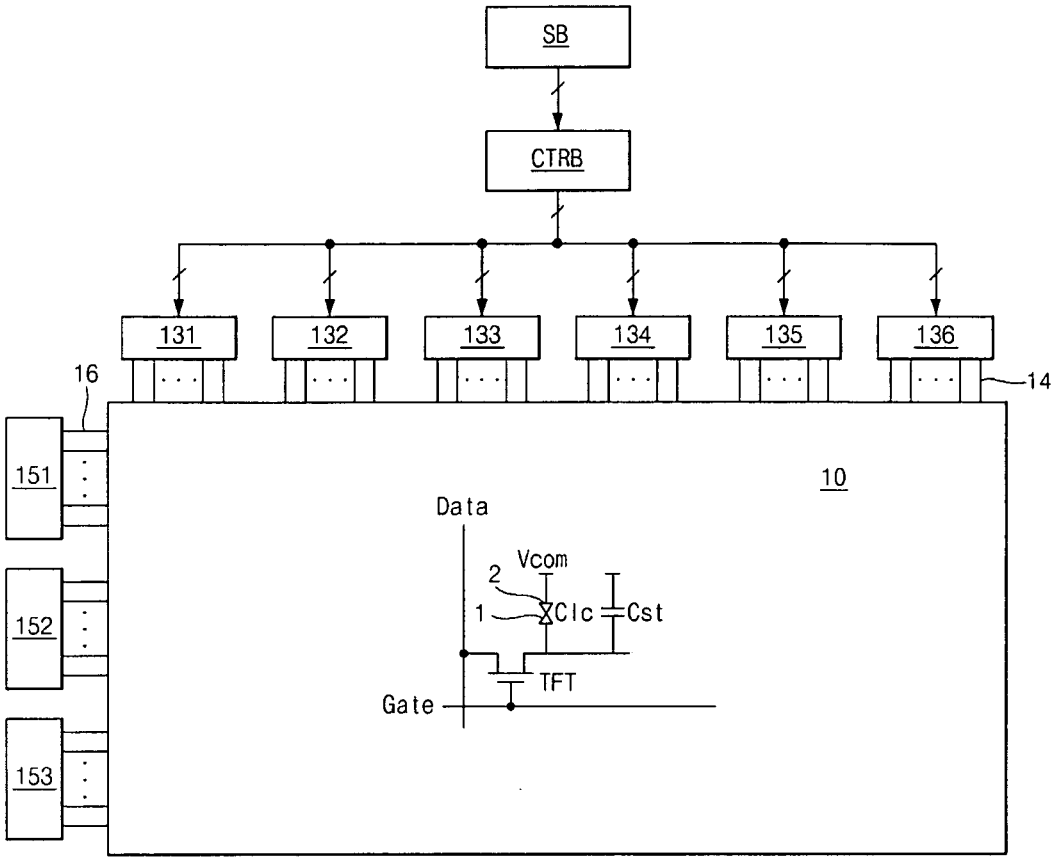
FIG. 3 is a block diagram illustrating a liquid crystal display device according to another embodiment of the present application.

FIG. 3 illustrates the liquid crystal display device according to the second exemplary embodiment.

Referring to FIG. 3, the liquid crystal display device according to the second exemplary embodiment may include a liquid crystal display panel 10, a plurality of gate driver ICs 151 to 153, a plurality of source drive ICs 131 to 136, a system board (SB), and a control board (CTRB). The liquid crystal display panel 10, the gate drive ICs 151 to 153, and the source drive ICs 131 to 136 may be substantially the same with those of the first embodiment so that the same reference numbers are used and the explanation for them are omitted.

The system board (SB) may convert the resolution of the digital video data to be in substantial accordance with the resolution of the liquid crystal display panel 10, and then send the digital video data and the timing signals in substantial accordance with the Vbyone interface specification.

The control board (CTRB) receives the Vbyone data and may convert the data into mini LVDS data. The control board (CTRB) may send the mini LVDS clock signal with the mini LVDS data to the source drive ICs 131 to 136. Also, the control board (CTRB) may generate the data timing control signal for controlling the operating timing of the source drive ICs 131 to 136 and the gate timing control signal for controlling the operating timing of the gate drive ICs 151 to 153.

Figure 4:
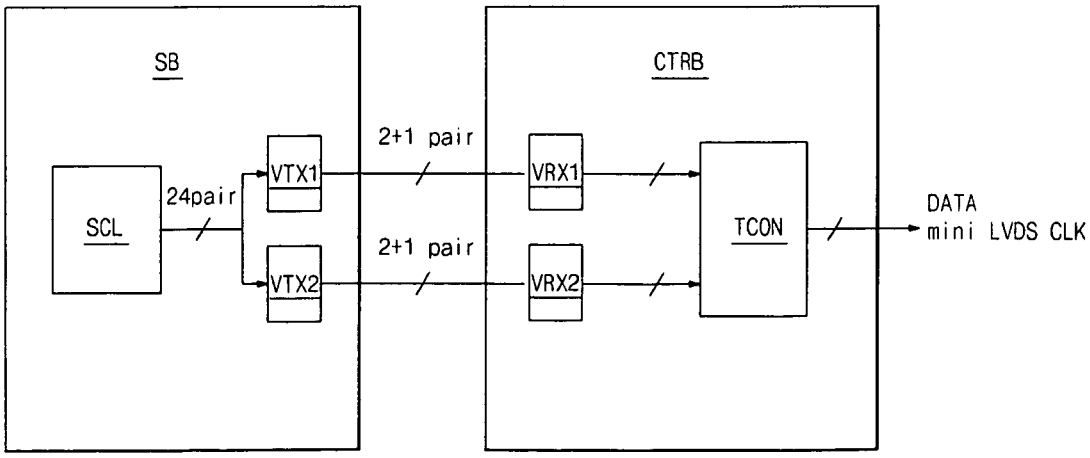
FIG. 4 is a block diagram illustrating the first embodiment of the system board and the control board shown in the FIG. 3.

FIG. 4 illustrates a more detailed first exemplary embodiment of the system board (SB) and the control board (CTRB) than as illustrated in the FIG. 3.

Referring to FIG. 4, the system board (SB) may be equipped with a scaler (SCL), and a first and second Vbyone transmitting circuit (VTX1 and VTX2). The scaler (SCL) may be equipped with a LVDS transmitting circuit. The scaler (SCL) may substantially convert the resolution of the digital video data and may send the digital video data and the timing signal with the LVDS clock signal to the first and second Vbyone transmitting circuits (VTX1 and VTX2) through the LVDS transmitting circuit. There may be data transmission between the scaler (SCL) and the first and second Vbyone transmitting circuit (VTX1 and VTX2). On the system board (SB), there may be 20-pairs of data transmitting lines and 4-pairs of clock transmission lines connecting the output terminals of the scaler to the input terminals of the Vbyone transmitting circuits (VTX1 and VTX2). The first Vbyone transmitting circuit (VTX1) may include the digital video data input from the scaler (SCL). The first Vbyone transmitting circuit (VTX1) may output the timing signal with the compressed digital video data. The second Vbyone transmitting circuit (VTX2) may include the digital video data input from the scaler (SCL) and may output the timing signal with the compressed digital video. Each of the Vbyone transmitting circuits (VTX1 or VTX2) may not generate the clock signal nor the auxiliary signal for substantially switching the operation of the Vbyone receiving circuit of the control board (CTEB) to the receiving mode.

Substantially located on the control board (CTRB), may be a first and a second receiving circuit (VRX1 and VRX2), and a timing controller (TCON).

The system board (SB) and the control board (CTRB) may be connected by a connector and a cable. The cable may include 4-pair of data transmitting lines and 2-pair of auxiliary signal transmitting lines, and may be in accordance with to the Vbyone interface specification. The first Vbyone transmitting circuit (VTX1) and the first Vbyone receiving circuit (VRX1) may be substantially connected through the 2-pair of data transmitting lines and 1-pair of auxiliary signal transmitting lines. After sending a response signal in response to the first Vbyone transmitting circuit (VTX1) auxiliary signal, the first Vbyone receiving circuit (VRX1) may receive and demodulate the digital video data through the 2-pair data transmitting lines, and then may send the demodulated data to the timing controller (TCON). After sending a response signal in response to the second Vbyone transmitting circuit (VTX2) receiving an auxiliary signal, the second Vbyone receiving circuit (VRX2) may receive and demodulate the digital video data through the 2-pair of data transmitting lines, and then may send the demodulated data to the timing controller (TCON).

The timing controller (TCON) may include a timing control signal generating circuit of the driving circuit, a data sampling circuit, and a mini LVDS transmitting circuit. By using the received timing signals such as Vsync, Hsync, data enable signal, and the dot clock signal, the timing controller (TCON) may generate the data timing control signal for controlling the operation timing of the source drive ICs 131 to 136 and for controlling the polarity of the data voltage supplied to the liquid crystal display panel 10. The timing controller (TCON) may also generate the gate timing control signal for controlling the operating timing of the gate drive ICs 151 to 153. In addition, the timing controller (TCON) may transmit the mini LVDS clock signal along with the digital video data to the source drive ICs 131 to 136 in substantial accordance with the mini LVDS interface specification.

Therefore, the liquid crystal display device according to the second exemplary embodiment may directly connect the system board (SB) with the control board (CTRB), and transmits the data between them using the Vbyone interface without substantially requiring the clock transmitting line. As a result, the EMI and the number of data transmitting lines can be substantially reduced.

Figure 5:
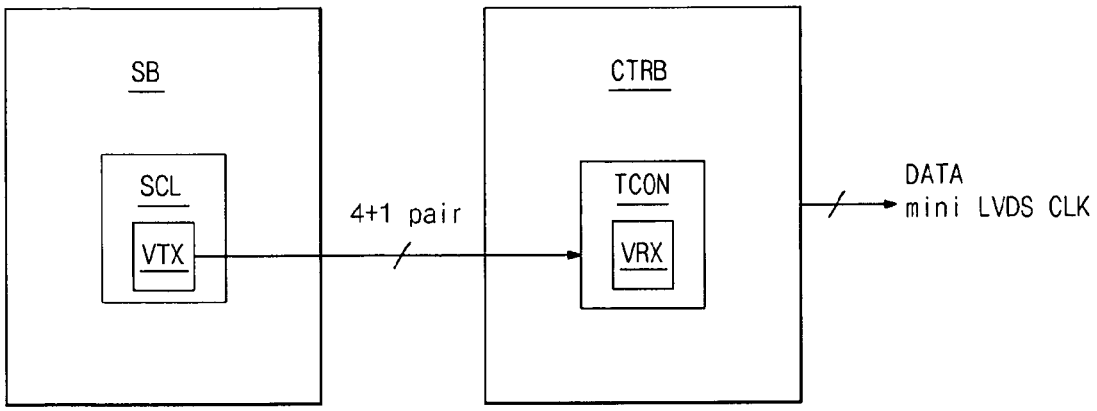
FIG. 5 is a block diagram illustrating the second embodiment of the system board and the control board shown in the FIG. 3.

FIG. 5 illustrates a more detailed second exemplary embodiment of the system board (SB) and the control board (CTRB) than as illustrated in the FIG. 3.

Referring to FIG. 5, the system board (SB) may be equipped with a scaler (SCL) and more. The scaler (SCL) may be equipped with a Vbyone transmitting circuit. The scaler (SCL) may substantially convert the resolution of the digital video data. The timing signal along with the digital video data, of which resolution may be converted and compressed by the Vbyone transmitting circuit which may be embedded into the scaler (SCL) which may be in substantial accordance with the Vbyone interface specification. The signal may then be sent to the control board (CTRB). Also, the Vbyone transmitting circuit of the scaler (SCL) may send the auxiliary signal to the control board (CTRB) prior to the data transmission.

The system board (SB) and the control board (CTRB) may be connected by a connector and a cable. The cable may include 4-pair data transmitting lines and 1-pair auxiliary signal transmitting lines, being in substantial accordance with the Vbyone interface specification. In this exemplary embodiment, the data may be sent by the Vbyone interface, between the scaler (SCL), which may be embedded into the system board (SB), and the timing controller (TCON), which may be embedded into the control board (CTRB), by using 1-pair of auxiliary signal transmitting lines.

The control board (CTRB) may be equipped with the timing controller (TCON).

The timing controller (TCON) may include a Vbyone receiving circuit, a timing control signal generating circuit of the driving circuit, a data sampling circuit, and a mini LVDS transmitting circuit. By using the received timing signals such as Vsync, Hsync, data enable signal, and the dot clock signal, the timing controller (TCON) may generate the data timing control signal for controlling the operation timing of the source drive ICs 131 to 136 and for controlling the polarity of the data voltage supplied to the liquid crystal display panel 10. The timing controller (TCON) may also generate the gate timing control signal for controlling the operating timing of the gate drive ICs 151 to 153. In addition, by using the Vbyone receiving circuit, the timing controller (TCON) may substantially demodulate the data substantially compressed by the Vbyone interface specification. By using the mini LVDS transmitting circuit, the timing controller (TCON) may convert the digital video data in substantial accordance with the mini LVDS interface specification, and may send the data with the mini LVDS clock signal to the source drive ICs 131 to 136.

According to the exemplary embodiment illustrated in FIG. 5, the number of parts related to the interface and embedded into both, the system board (SB) and the control board (CTRB) may be reduced. The data transfer between the system board (SB) and the control board (CTRB) may be performed using the Vbyone interface wherein substantially no clock transmitting line is required. Therefore, it may be possible to reduce the EMI and the number of data transmitting lines.

Figure 6:
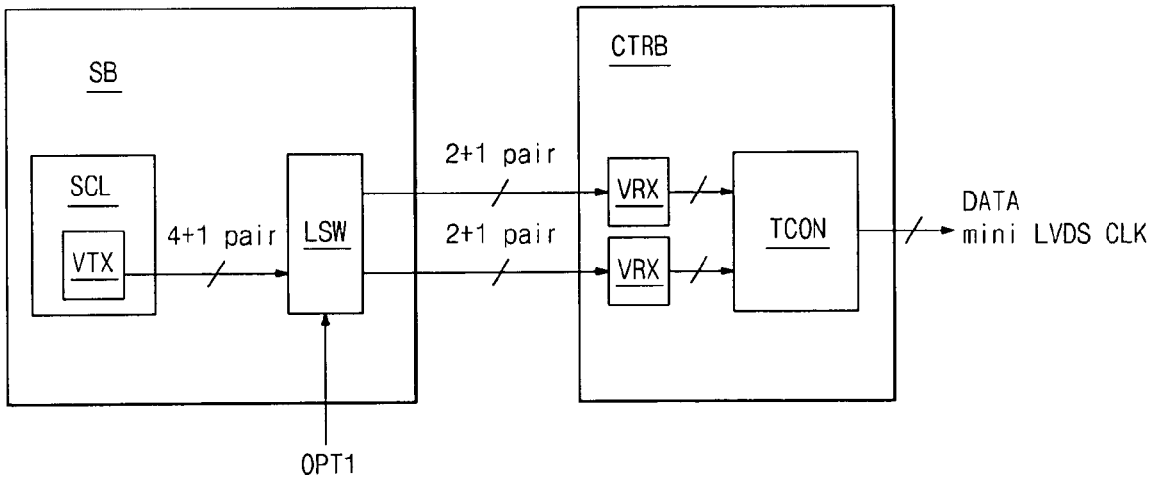
FIG. 6 is a block diagram illustrating the third embodiment of the system board and the control board shown in the FIG. 3.
Figure 7:
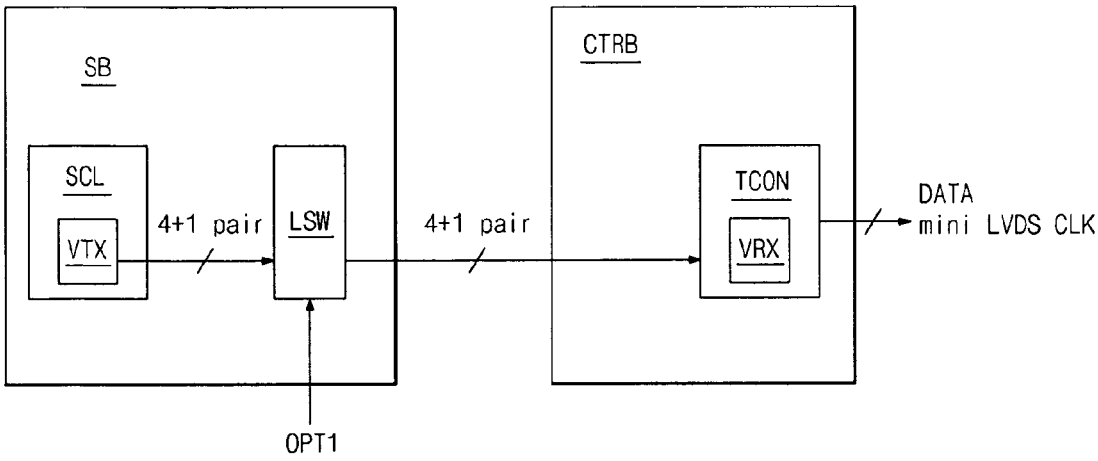
FIG. 7 is a block diagram illustrating the fourth embodiment of the system board and the control board shown in the FIG. 3.
Figure 8:
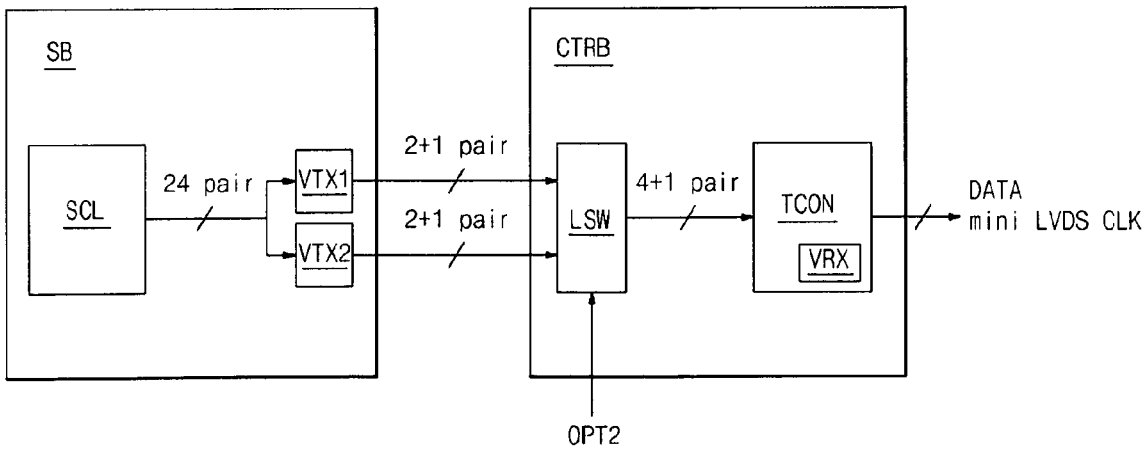
FIG. 8 is a block diagram illustrating the fifth embodiment of the system board and the control board shown in the FIG. 3.

In the interim, as illustrated in FIG. 5, substantially any one of the scalers (SCL) and system boards (SB) may be equipped with the Vbyone transmitting circuit or receiving circuit. In this exemplary embodiment, as the number of auxiliary signal outputs from the Vbyone interface transmitting terminal differ from the number of auxiliary signals required at Vbyone interface receiving terminal, a signal line switching circuit may be required for matching the number of auxiliary signal to substantially maintain compatibly. FIGS. 6 through 8 illustrate exemplary embodiments of using a signal line switching circuit for matching the lines between the Vbyone interface transmitting terminal.

FIG. 6 illustrates a more detailed third exemplary embodiment of the system board (SB) and the control board (CTRB) than that illustrated in FIG. 3.

Referring to FIG. 6, the system board (SB) may be equipped with a scaler (SCL), and a line switching circuit (LSW). The scaler (SCL) may be equipped with a Vbyone transmitting circuit. The Vbyone transmitting circuit which may be substantially embedded into the scaler (SCL) may send an auxiliary signal to the control board (CTRB) and may receive a response signal from the Vbyone receiving circuit. The Vbyone transmitting circuit may then compress the digital video data and the timing signals in substantial accordance with the Vbyone interface specification, and may send the data and signals to the control board (CTRB).

The scaler (SCL) and the line switching circuit (LSW) may be connected through 4-pair of data transmitting lines and the 1-pair of auxiliary signal transmitting lines without any clock transmitting line.

The line switching circuit (LSW) substantially controls the auxiliary signal pair which may output in response to the option signal (OPT1) input into the control terminal of itself. The option signal (OPT1) may be decided by the voltage supplied to the control terminal of the line switching circuit (LSW). For example in one exemplary embodiment, if the common voltage (Vcc) is applied to the control terminal of the line switching circuit (LSW), the logic value of the option signal (OPT1) may be HI, that may be "1". If a ground voltage (GND) is supplied to the control terminal of the line switching circuit (LSW) through a pull down resistor, the logic value of the option signal (OPT1) may be LO, that may be a "0". In the exemplary embodiments illustrated in FIGS. 6 and 7, the line switching circuit (LSW) may generate 2-pair of auxiliary signals when the HI option signal (OPT1) is applied to the control terminal of the line switching circuit (LSW). The line switching circuit (LSW) may generate a 1-pair auxiliary signal when the LO option signal (OPT1) is supplied to the control terminal of the line switching circuit (LSW). However, the operation of the line switching circuit (LSW) may not be restricted by this condition. For example, the line switching circuit (LSW) may generate a 1-pair auxiliary signal when the HI option signal (OPT1) is applied to the control terminal of the line switching circuit (LSW). The line switching circuit (LSW) may generate a 2-pair auxiliary signal when the LO option signal (OPT1) is supplied to the control terminal of the line switching circuit (LSW).

The control board (CTRB) may be equipped with two Vbyone receiving circuits (VRXs), and a timing controller (TCON). The system board (SB) and the control board (CTRB) may be connected by a connector and a cable. The cable may include the 4-pairs of data transmitting lines and the 1-pair of auxiliary signal transmitting lines without any clock signal transmitting line.

Each Vbyone receiving circuit (VRX) may be supplied an auxiliary signal in order to receive the data with the Vbyone interface. Therefore, each input terminal of the Vbyone receiving circuit (VRX) should be connected to 2-pairs of data transmitting lines and 1-pair of auxiliary signal transmitting lines. In the interim, the scaler (SCL) of the system board (SB) may output the digital video data and the timing signal through 4-pairs of data transmitting lines and the auxiliary signal through 1-pair of auxiliary transmitting lines. Therefore, the number of auxiliary signals required for the Vbyone transmitting terminal may not match the number of auxiliary signals required for the Vbyone receiving terminal.

To match the number of auxiliary signal lines, the control terminal of the line switching circuit (LSW) that may be embedded into the system board (SB), HI logic option signal (OPT1) may be applied. Therefore, the line switching circuit (LSW) distributes the auxiliary signal from the scaler (SCL) which may be input through 1-pair of auxiliary signal lines to 2-pair of auxiliary signal transmitting lines, wherein each of them may be connected to the Vbyone receiving circuit (VRX). In addition, the line switching circuit (LSW) may distribute the digital video data and the timing signals from the scaler (SCL) through 4-pairs of data transmitting lines to the 4-pair of auxiliary signal transmitting lines, wherein each 2-pair may be connected to two Vbyone receiving circuits (VRXs).

Each of Vbyone receiving circuits (VRXs) may transmit a response signal to the received auxiliary signal of the Vbyone transmitting circuit of the scaler (SCL) through the line switching circuit (LSW), and may demodulate the digital video data transmitted in the Vbyone interface specification through the line switching circuit (LSW), and then transmit the data with the timing signal to the timing controller (TCON).

The timing controller (TCON) may include a timing control signal generating circuit of the driving circuit, a data sampling circuit, and a mini LVDS transmitting circuit. Using the received timing signals received from two Vbyone receiving circuits (VRXs) such as Vsync, Hsync, data enable signal, and dot clock, the timing controller (TCON) generate the data timing control signal for controlling the operating timing of the source drive ICs 131 to 136 and for controlling the polarity of the data voltage supplied to the liquid crystal display panel 10. Further, the timing controller (TCON) may generate the gate timing control signal for controlling the operating timing of the gate drive ICs 151 to 153. According to the mini LVDS interface specification, the timing controller (TCON) may send the data with the mini LVDS clock signal to the source drive ICs 131 to 136.

FIG. 7 illustrates a more detailed fourth exemplary embodiment of the system board (SB) and the control board (CTRB) then illustrated in FIG. 3.

Referring to FIG. 7, the configuration of the system board (SB) is similar of which is illustrated in FIG. 6, except that the LO logic option signal may be supplied to the control terminal of the line switching circuit (LSW). Therefore, the scaler (SCL) and the line switching circuit (LSW) may be connected through 4-pair of data transmitting lines and 1-pair of auxiliary transmitting lines without a clock transmitting line. Through these transmitting lines, the scaler (SCL) may transmit the digital video data, the timing signal which may be substantially compressed by the Vbyone interface specification, and the auxiliary signal to the line switching circuit (LSW).

The control board (CTRB) is substantially the same as the exemplary embodiment illustrated in FIG. 5. Therefore, the control board (CTRB) may be equipped with the timing controller (TCON). The control board (CTRB) may be connected to the line switching circuit (LSW) of the system board (SB) through the cable including 4-pair of data transmitting lines and 1-pair of auxiliary signal transmitting line and the connector for linking the cable to each board.

The timing controller (TCON) may include a Vbyone receiving circuit, a timing control signal generating circuit of the driving circuit, a data sampling circuit, and a mini LVDS transmitting circuit. Therefore, the input terminal of the timing controller (TCON) may be connected to 4-pair of data transmitting lines and 1-pair of auxiliary signal transmitting lines formed at the cable.

The LO logic option signal (OPT1) may be applied to the control terminal of the line switching circuit (LSW) which can be located on the system board (SB). Therefore, the line switching circuit (LSW) may bypass the auxiliary signal which may input from the scaler (SCL) through the 1-pair of auxiliary signal transmitting lines to the 1-pair auxiliary signal transmitting lines which may be connected to the auxiliary signal receiving terminal of the timing controller (TCON). Further, the line switching circuit (LSW) may transmit the digital video data and the timing signals received from the scaler (SCL) through the 4-pair of data transmitting lines to the 4-pair of data transmitting lines which may be connected to the data input terminal of the timing controller (TCON).

Figure 9:
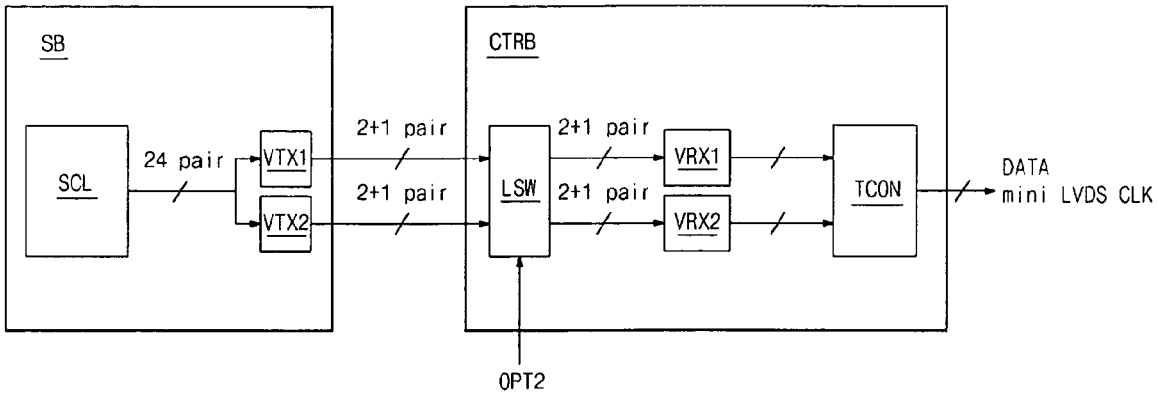
FIG. 9 is a block diagram illustrating the sixth embodiment of the system board and the control board shown in the FIG. 3.

FIGS. 8 and 9 illustrate the 5th and 6th exemplary embodiments of the system board (SB) and the control board (CTRB), respectively, in more detail than illustrated in FIG. 3. Contrary to the 3rd and 4th embodiments, and in accordance with the 5th and 6th embodiments, the line switching circuit (LSW) may be mounted on the control board (CTRB).

Referring to the FIG. 8, the system board (SB) is equipped with a scaler (SCL), a first and a second Vbyone transmitting circuit (VTS1 and VTX2), substantially similar to the embodiment illustrated in FIG. 4. The scaler (SCL) may be equipped with the LVDS transmitting circuit. The scaler (SCL) may output the digital video data and the timing signals through the embedded LVDS transmitting circuits and the 20-pair of data transmitting lines. Through the 4-pair of clock transmitting lines, the scaler (SCL) may output the LVDS clock. Each of Vbyone transmitting circuits (VTX1 and VTX2) may substantially compress the digital video data received from the scaler (SCL) in substantial accordance with the Vbyone interface specification, and may output the compressed digital video data with the timing signal. Further, each of Vbyone transmitting circuits (VTX1 and VTX2) may output 1-pair of auxiliary signals. The output terminal of the Vbyone transmitting circuit (VTX1 and VTX2) may be connected to the input terminal of the line switching circuit (LSW) which may be embedded on the control board (CTRB) through the cable connecting the system board (SB) and the control board (CTRB). The cable may include 4-pair of data transmitting lines and 2-pair of auxiliary signal transmitting lines.

The timing controller (TCON) substantially mounted on the control board (CTRB) may include a Vbyone receiving circuit, a timing control signal generating circuit of the driving circuit, a data sampling circuit, and a mini LVDS transmitting circuit. The Vbyone receiving circuit of the timing controller (TCON) may require 4-pair of data transmitting lines and 1-pair of auxiliary signal transmitting lines. On the contrary, each of Vbyone transmitting circuits of the system board (SB) may generate a pair of auxiliary signals. Therefore, the number of auxiliary signals output from the system board (SB) may not be matched with the number of auxiliary signal input in to the timing controller (TCON).

The line switching circuit (LSW) may control the pair of auxiliary signals output in accordance with the option signal (OPT2) input to the control terminal of itself. The option signal (OPT2) may be decided by the voltage applied to the control terminal of the line switching circuit (LSW). In the exemplary embodiments illustrated in FIGS. 8 and 9, the line switching circuit (LSW) may substantially convert the 2-pair of auxiliary signals to 1-pair of auxiliary signal lines in response to the HI logic option signal (OPT2), and may transmit that through the 1-pair of auxiliary signal transmitting line. In response to the LO logic option signal (OPT2), the line switching circuit (LSW) may send the 2-pairs of auxiliary signal to the 2-pair of auxiliary signal transmitting lines directly. The operation of the line switching circuit (LSW) may not be restricted by the above-mentioned condition. For example, the line switching circuit (LSW) may output the 2-pair of auxiliary signals in response to the HI logic option signal (OPT1) and output the 1-pair of auxiliary signal in response to the LO logic signal (OPT1).

In the exemplary embodiment of FIG. 8, the HI logic option signal (OPT2) may be input into the control terminal of the line switching circuit (LSW). Therefore, the line switching circuit (LSW) may substantially convert the 2-pair of auxiliary signals which are input through the 2-pair of auxiliary signal transmitting lines into the 1-pair of auxiliary signals, and supply the auxiliary signals to the timing controller (TCON) through the 1-pair of auxiliary signal transmitting lines. In addition, the line switching circuit (LSW) may supply the digital video data and the timing signals received through the 4-pair of data transmitting lines to the data input terminals and the timing signals input into the terminal through the 4-pair of data transmitting lines.

Referring to FIG. 9, the system board may be substantially the same as the exemplary embodiment illustrated in FIG. 8. Each of Vbyone transmitting circuits (VTX1 and VTX2) of the system board (SB) may substantially compress the digital video data input from the scaler (SCL) according to the Vbyone interface specification, and may output the substantially compressed digital video signal with the timing signal. Further, Each of Vbyone transmitting circuits (VTX1 and VTX2) output 1-pair of auxiliary signals. The system board (SB) and the control board (CTRB) may be connected by the connector and cable. Therefore, the system board (SB) may transmit the digital video data and the timing signals to the control board (CTRB) through the 4-pair of data transmitting lines formed at the cable, and transmit the auxiliary signals to the control board (CTRB) through the 2-pair of auxiliary signal transmitting lines formed at the cable.

On the control board (CTRB), a line switching circuit (LSW), a first and a second Vbyone receiving circuit (VRX1 and VRX2), and a timing controller (TCON) may be included. The control board (CTRB) may be connected to the line switching circuit (LSW) of the system board (SB) through the cable the cable including 4-pairs of data transmitting lines, 2-pair of auxiliary signal transmitting lines, and the connectors for linking the cable to each board.

The LO logic option signal (OPT2) is applied to the control terminal of the line switching circuit (LSW). Therefore, the line switching circuit (LSW) may output the 2-pair of auxiliary signal inputs directly through the 2-pair of auxiliary signal transmitting lines in response to the LO logic option signal (OPT2) to the 2-pair of auxiliary signal transmitting lines. The 2-pair of data and the 1-pair of auxiliary signals coinciding with the output of the line switching circuit (LSW) can be supplied to the first Vbyone receiving circuit (VRX1) and the other 2-pair of data and 1-pair of auxiliary signal may be supplied to the second Vbyone receiving circuit (VRX2).

Each of the Vbyone receiving circuits (VRX1 and VRX2) substantially demodulate the received digital video data, according to the Vbyone interface specification, and also supplies them to the timing controller (TCON).

In the interim, the above-mentioned exemplary embodiments are examples of when the liquid crystal display panel is operated in Full HD 120 Hz mode. Therefore, if the resolution of the liquid crystal display panel or the driving frequency is changed, then the number of lines of interfaces may be different.

In the above-mentioned exemplary embodiments, the Vbyone interface type may be replaced with any interface type in which the required number of the transmitting lines may be smaller than those of the LVDS interface type. For example, the LVDS interface type may be replaced with the RSDS (Reduced Swing Differential Signaling) interface type.

As mentioned above, the liquid crystal display device according to the exemplary embodiments may accept the type of interface in which no clock transmitting line and the number of the required data transmitting lines is less. Therefore, it is realized that the number of signal transmitting lines may be reduced and EMI problem may be substantially improved and compatible with conventional interfaces.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

a liquid crystal display panel on which a plurality of data lines cross a plurality of gate lines, wherein each data line and each gate line is connected to a thin film transistor;

a source drive IC that supplies data voltages to the data lines;

a gate drive IC that supplies gate pulses to the gate lines;

a system board equipped with a scaler that transmits data from the scaler with a first interface specification;

an interface board that receives the data according to the first interface specification, and transmitting the data with a second interface specification; and a control board equipped with a timing controller receiving the data in the second interface specification and supplying the data to the source drive IC, and controlling the operating timing of the source drive IC and the gate drive IC;

wherein the interface board is connected between the system board and the control board, the interface board includes:

a receiving circuit that receives a digital video data with a clock signal according to the first interface specification from the system board;

a transmitting circuit that outputs an auxiliary signal at a low frequency and then outputs the digital video data without a clock signal with the second interface specification; and a relay circuit connected between the receiving circuit and the transmitting circuit, wherein the relay circuit demodulates the digital video data received from the receiving circuit with the clock signal according to the first interface specification and supplies the digital video data to the transmitting circuit, wherein a number of the data transmitting lines required in the second interface specification is less than a number of data transmitting line required in the first interface specification.

* * * * *